United States Patent [19]

Staashelm

[11] Patent Number: 4,485,928

[45] Date of Patent: Dec. 4, 1984

[54] ARTICLE STORAGE RACK

[76] Inventor: Henry E. Staashelm, 5305 Lakeside Dr., Palm Springs, Calif. 92264

[21] Appl. No.: 352,777

[22] Filed: Feb. 26, 1982

[51] Int. Cl.[3] ..... A47F 5/08

[52] U.S. Cl. ..... 211/35; 211/1.3; 211/38; 211/104; 312/246; 312/321

[58] Field of Search ..... 211/38, 35, 31, 32, 211/104, 1.3, 79, 80, 195, 94, 94.5; 312/245, 248, 246, 247, 321

[56] References Cited

U.S. PATENT DOCUMENTS

| | | | |
|---|---|---|---|
| 2,492,697 | 12/1949 | Higley | 312/322 |
| 2,586,543 | 2/1952 | Kennedy | 312/322 X |
| 2,861,300 | 11/1958 | Friedenreich | 312/321 |
| 3,001,650 | 9/1961 | Turner | 211/34 |
| 3,027,215 | 3/1962 | Duncan | 312/323 X |
| 3,162,311 | 12/1964 | Scott | 211/34 |
| 3,485,544 | 12/1969 | Beckerman | 312/248 |
| 3,563,390 | 2/1971 | Kim | 211/35 |
| 3,846,005 | 11/1974 | Harper et al. | 312/248 |

*Primary Examiner*—Ramon S. Britts
*Assistant Examiner*—Robert W. Gibson, Jr.
*Attorney, Agent, or Firm*—I. Louis Wolk

[57] ABSTRACT

The invention relates to a rack for the storage of shoes or other objects which is designed to be mounted on the ceiling or wall of a clothes closet having article retaining means positioned upon a platform which is forwardly slideable, preferably at a downward angle to permit ready access to the stored objects and which can be retracted to a normal storage position.

1 Claim, 2 Drawing Figures

ARTICLE STORAGE RACK

FIELD OF THE INVENTION

This invention relates to a storage means for shoes or other objects adopted to be installed in a convenient and readily accessible manner in a closet or other storage area.

BACKGROUND AND PRIOR ART

Racks for shoes and the like have previously been designed for hanging upon closet rods, as for example shown in U.S. Pat. No. 2,299,021, or U.S. Pat. No. 3,913,745. Similar devices have been designed to be mounted upon closet walls or doors. These devices have the disadvantage that they occupy usable hanging space for garments in a closet, or else interfere with access to the closet or to garments hanging from a closet rod.

SUMMARY AND OBJECTS OF THE INVENTION

This invention comprises a framework which is designed for horizontal attachment to a wall or ceiling, in an elevated position, for example, above normally positioned garments or other objects in a closet or storage area. A horizontal platform with members for supporting shoes or other articles, i.e., hats, is positioned upon said framework which is mounted in a forwardly slideable manner to permit access to the article supporting means. The platform is resiliently retained by means of springs or the like and can be retracted to normal storage position. In order to facilitate access to the articles on the platform, it is attached to the supporting framework in a hinged manner so that as it is drawn forward it can also depend at a desired downward angle. One way of achieving this result is by positioning the platform on one or more tracks which are a part of the supporting framework which is itself hinged to permit the desired angular position. To permit suitable retraction of the platform, springs are provided which may be mounted upon the hinged platform supporting structure which is itself provided with springs or other resilient means adapted to retract the hinged structure into normal horizontal storage position.

It is therefore, an object of the present invention to provide an improved storage rack for horizontal mounting in an elevated position upon the ceiling or wall of a storage area.

It is further object of the invention to provide a storage rack which will be positioned horizontally in an elevated position and which has an article storing tray or platform which can be drawn forward to provide access to the stored objects and be retractably returned to normal position.

It is still further object of the invention to provide a storage rack having a storage platform which can be retractably drawn forward and downward at a desired angle in order to facilitate access to the articles and their retaining means.

These and other objects and advantages of the invention will be referred to in the following detailed description as illustrated in the accompanying drawing.

DRAWING AND DETAILED DESCRIPTION

Figure 1:
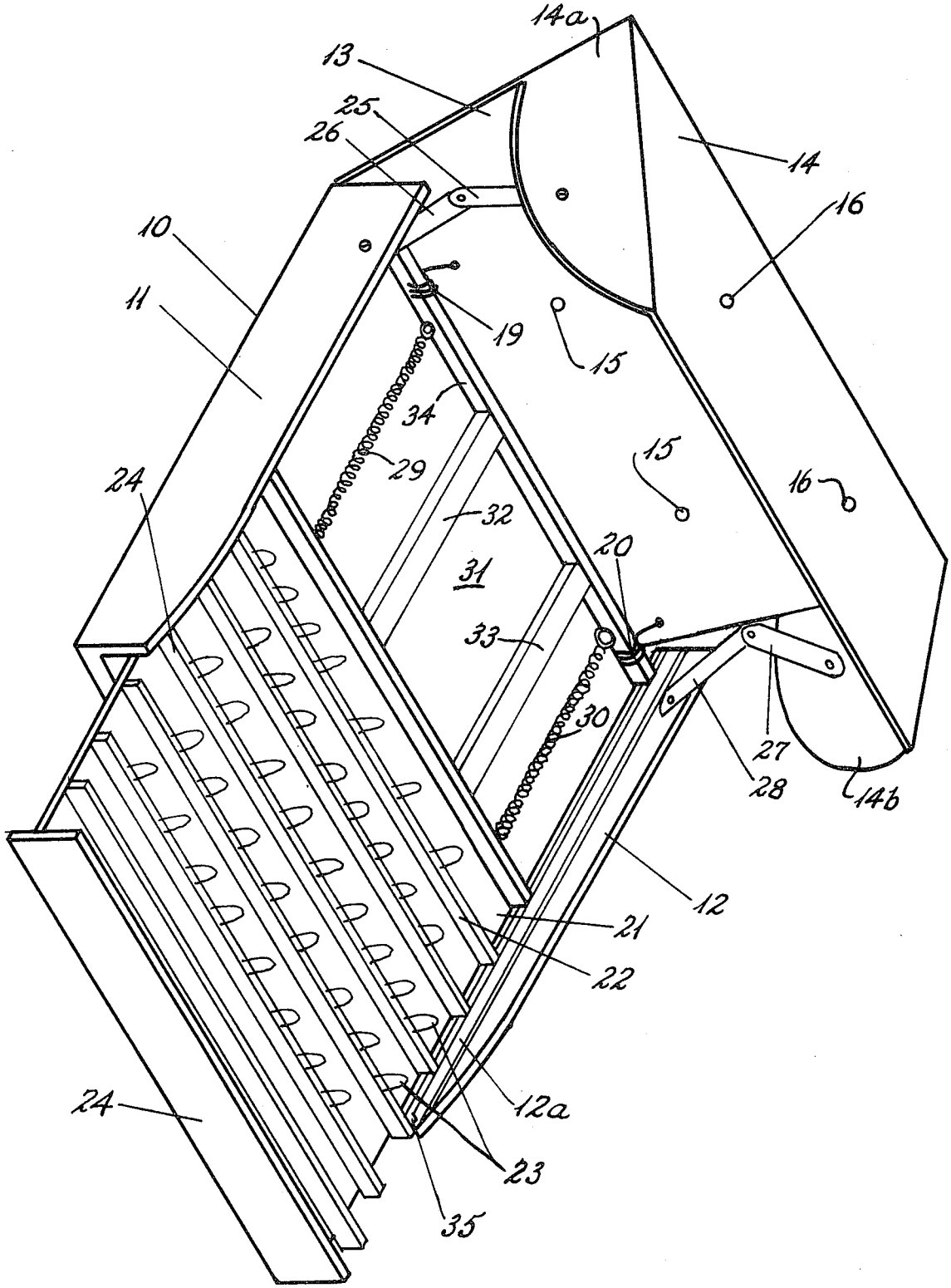

In the drawings, FIG. 1 is a view in isometric perspective of the device in extended position for positioning or removal of articles.

Figure 2:
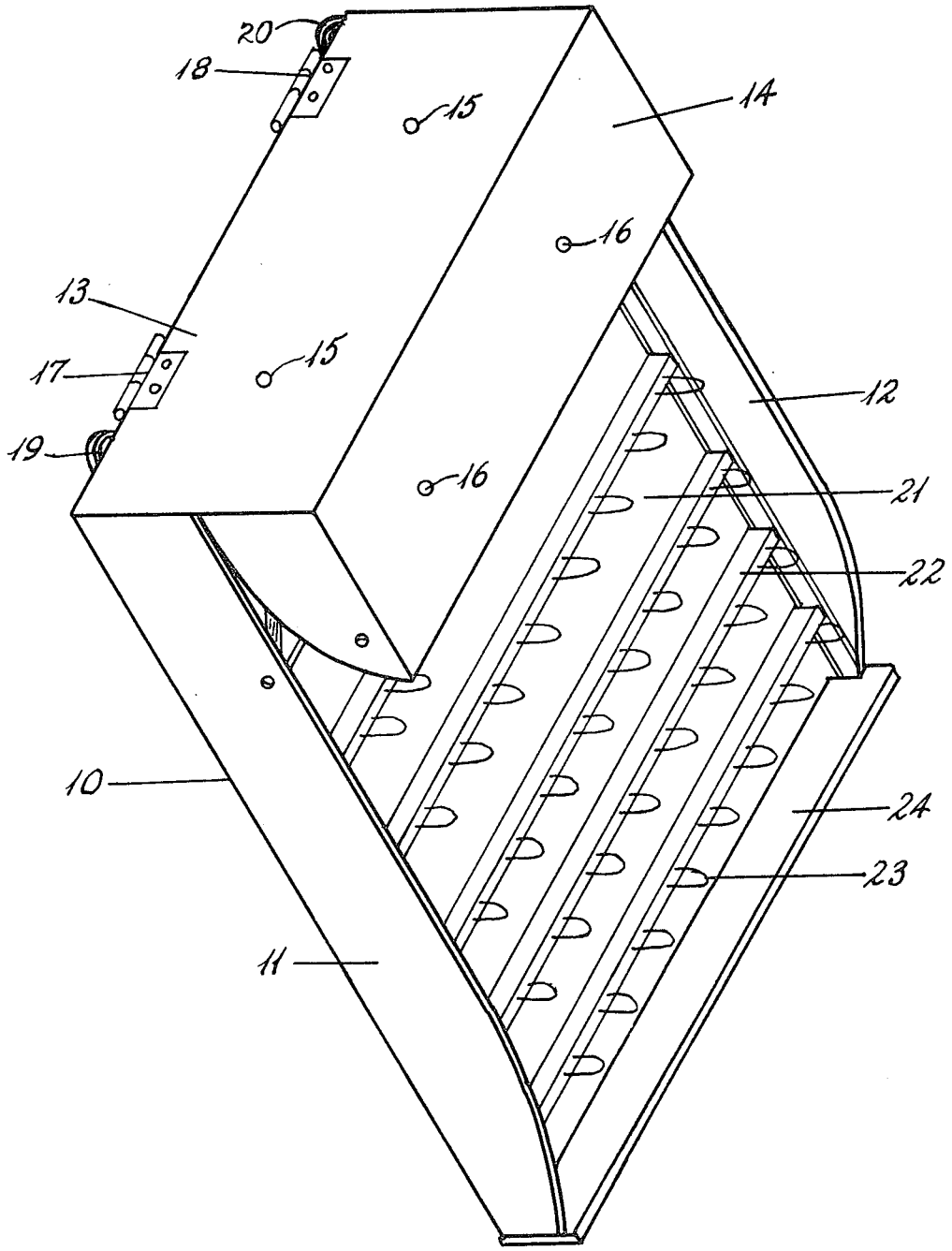

FIG. 2 is a view in isometric perspective of the article supporting device in normal storage position.

As shown in FIGS. 1 and 2 the device 10 is formed with side panels 11 and 12 attached to a base member 31. Attached to the base member is a rear panel member 13 formed with an overhanging canopy 14 having side members **14*a* and 14*b*. The base member and the respective panel members are formed of rigid sheet plastic plywood, or the like of suitable thickness to provide sufficient rigidity, i.e., $\frac{1}{4}$–$\frac{3}{8}$ inches would be generally suitable. Panels 13 and 14 are provided with holes 15 and 16 respectively for attachment to a ceiling or wall as further explained below. As shown in FIG. 1 the rear panel member is attached to the base by means of hinges 17 and 18 which may themselves be spring-loaded or springs 19 and 20 are provided which normally urge the unit formed by 13 and 14** into right angular or "closed" position.

Superimposed upon base member 31 is a flat sheet member 21 formed of rigid plastic, plywood or suitable material of a thickness similar to the base or panel member, and which is slideably mounted upon tracks or spacers 32 and 33 mounted longitudinally upon base member 31 and braced against a back strip 34. The side edges of member 21 are slideably engaged by grooves 35 formed along the slides between right angular strap **12*a*** and the base at both sides.

The slideable panel or tray 21 is retained at the side edges of panel members 11 and 12 in grooves extending longitudinally thereof. Springs 29 and 30 are attached to the slideable panel either at the rear thereof, preferably beneath it and to the rear back strip 34 and which normally urge the slideable panel rearward, while permitting it to be drawn forward to provide access to the article supporting members shown as a plurality of upwardly projecting metal loops 23, attached to a plurality of ribs 22 designed to engage shoes, hats or other objects.

As shown in FIG. 1, the hinged base member is also attached to overhanging canopy member 14 by means of a flexible linkage 25, 26, and 27, 28 which also act as a detent.

Installation of the article carrier is made by attaching it to a ceiling or wall in elevated position. Where attachment to a ceiling is desired, upper panel member 14 is secured flush against the ceiling of a closet or the like by means of bolts through holes 16, or by other desired means. This spaces the article carrying tray from the ceiling by the width of rear panel 13, say 8–12 inches. The tray is thus maintained horizontally, parallel to the ceiling. When it is desired to install or remove articles, by pulling forward and down upon end strip 24, the tray is drawn forward and down again the springs 29 and 30; at the same time the base member which is hinged at the back and which supports the carrier tray is tilted down against springs 19 and 20 and the angle of tilt is controlled by the pairs of linked arms 25,26 and 27,28. This permits the article carrier to be drawn down and forward at a desired angle which permits easy access to the stored articles. Springs 19 and 20 may be replaced or supplemented by springs which are built into hinges 17 and 18 or by other suitable spring means designed to normally retain the carrier in a position parallel to the ceiling.

When it is desired to return the carrier to storage position, the carrier tray 21 is released and brought back to storage position assisted by springs 29 and 30, and at the same time the base is allowed to return to its horizontal position under the impetus of springs 19 and 20.

Where it is desired to attach the carrier to the wall of a closet, rear panel 13 is mounted against the wall by means of bolts through openings 15 or the like, preferably at a point near the ceiling. This permits the article carrier tray to be drawn down and forward as described above.

In the use of the carrier for shoe storage, the unit is dimensioned to permit the placing of the desired number of pairs of shoes upon the article retainers 23 or the like. Generally the article carrying tray may be from 18–36 inches in width and length. Where articles such as hats are to be stored, the width of the rear panel may be greater to accommodate such articles, where attachment to the ceiling is desired. In the case of wall attachment, the desired spacing may be achieved by mounting at a higher or lower vertical point.

I claim:

1. An article storage unit adapted to be attached in an elevated position while permitting access to articles stored on a slidable dependent storage member, which comprises an enclosure having a base member and side walls, a rear wall attached to said base member at the bottom edge only of said base member by means of a hinge, spring means positioned to normally urge said base member into upright closed position, an upper member attached to said rear wall extending forwardly thereof, said rear wall and said upper member providing surfaces for attachment to a vertical wall or ceiling, respectively, an articulated brace attached from each side of said upper member to each side wall of said base member at the rear portion thereof, an article supporting storage shelf member slidably positioned within said enclosure supported on slides upon said base member with the edges of said shelf member in slidable engagement with grooves formed longitudinally of the side walls of said enclosure, spring means attached at one end to the rear portion of said shelf member and at the other end to the rear of said base member, said spring means normally urging said shelf member rearwardly in superimposed position over said base member, while permitting said shelf member to be drawn forward in dependent position to facilitate access to said articles while at the same time causing axial downward movement between the base member and the rear wall along the hinge, with said rear wall being supported in a vertical position, said articulated braces permitting downward movement of the base member to a predetermined point.

* * * * *